United States Patent [19]

Howard

[11] Patent Number: 4,538,371

[45] Date of Patent: Sep. 3, 1985

[54] MAGAZINE LOADER AND CARTRIDGE CLIP USEFUL THEREWITH

[76] Inventor: William J. Howard, P.O. Box 573, Wilson, N.C. 27893

[21] Appl. No.: 436,655

[22] Filed: Oct. 26, 1982

[51] Int. Cl.[3] ..... F42C 27/00

[52] U.S. Cl. ..... 42/87

[58] Field of Search ..... 42/87, 88

[56] References Cited

U.S. PATENT DOCUMENTS

| | | | |
|---|---|---|---|
| 447,577 | 3/1891 | Milovanovitch-Koka | 42/88 |
| 2,451,521 | 10/1948 | Uglum | 42/87 X |
| 2,462,836 | 3/1949 | Barker et al. | 42/88 |
| 2,783,570 | 3/1957 | Kunz | 42/87 |
| 2,799,957 | 7/1957 | Kintzer | 42/50 |
| 2,834,137 | 5/1958 | Kunz | 42/87 |
| 3,222,810 | 12/1965 | Musgrave | 42/87 |
| 3,916,552 | 11/1975 | Pichard et al. | 42/87 |

*Primary Examiner*—David H. Brown

*Attorney, Agent, or Firm*—Quaintance & Murphy

[57] ABSTRACT

A magazine loader and a cartridge clip for rapidly and easily loading cartridges into a firearm magazine. The magazine loader comprises a cartridge-neck holder and a cartridge-base holder, both attached to a skirt. The base holder is adapted to receive cartridges held by a standard retainer strip or the novel cartridge clip.

7 Claims, 11 Drawing Figures

MAGAZINE LOADER AND CARTRIDGE CLIP USEFUL THEREWITH

Figure 1:
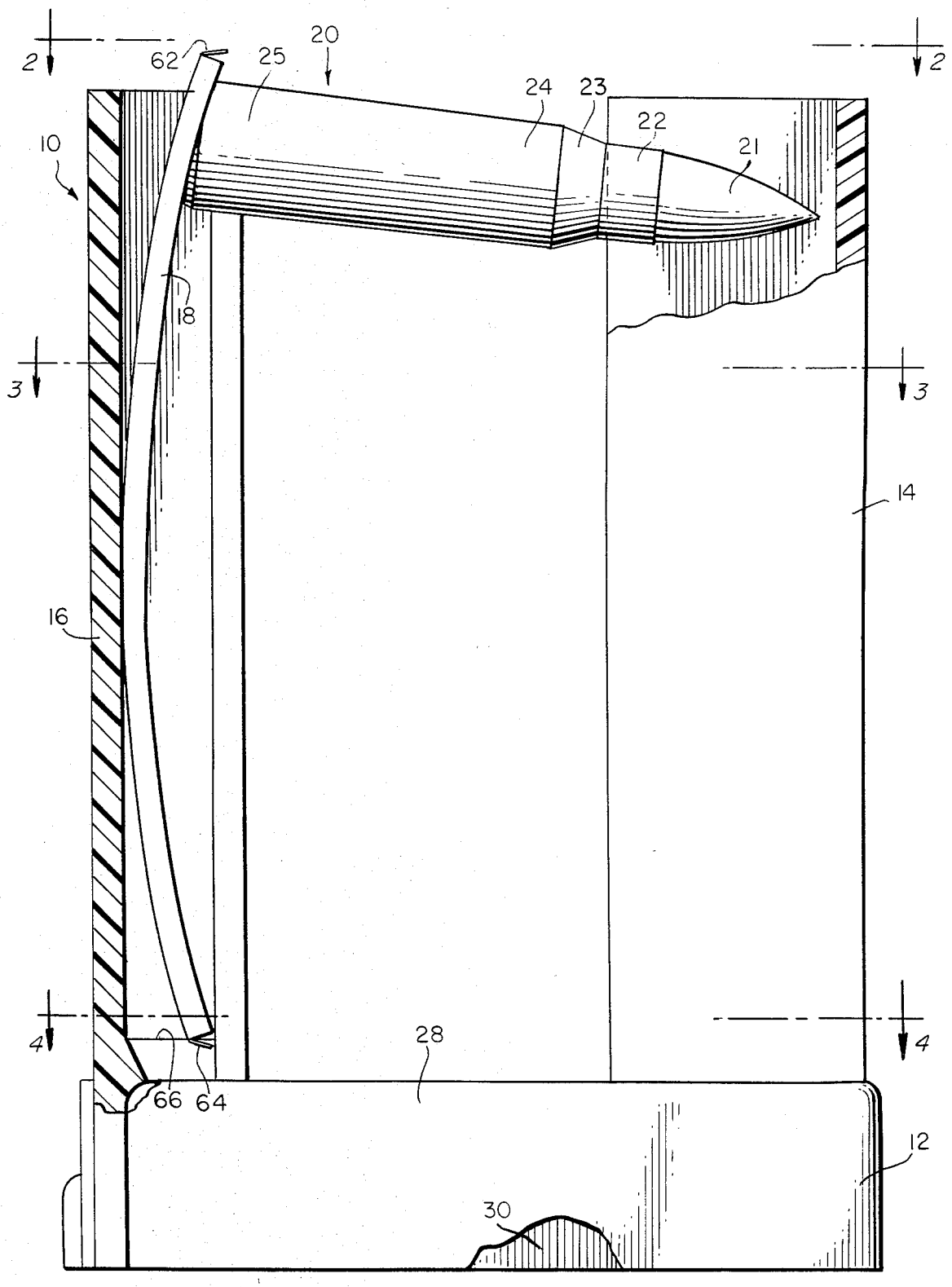

Magazine loaders for loading cartridges into a firearm magazine have been known since prior to the turn of the century. See Milovanovitch-Koka, U.S. Pat. No. 447,577, issued Mar. 3, 1891. More recent attempts to provide magazine loaders are described in Kunz, U.S. Pat. No. 2,783,570, and Kintzer, U.S. Pat. No. 2,799,957.

Unfortunately, all prior magazine loaders suffer from a number of disadvantages. Many prior magazine loaders are complicated and expensive to manufacture. They are made of a number of parts which must be assembled. Many prior magazine loaders are useful only when the magazine is already inserted in the firearm.

In the United States of America, among the countries of the North Atlantic Treaty Organization (NATO) and in other countries, much firearm ammunition exists wherein the cartridges are held by a metal retainer strip. This retainer strip is manufactured under U.S. Government Stock No. 11,010,483. Most prior magazine loaders require the individual cartridges to be removed from the retainer strip and placed in the magazine loader prior to employing the magazine loader to load the magazine. Removing the cartridges one by one from the retainer strip is a burdensome operation rendering the magazine loader substantially useless. If the user of the firearm is required to remove cartridges one by one from the retainer strip, it is easier to load the cartridges one by one into the magazine directly, instead of employing a magazine loader.

The prior-art metal retainer strips suffer from a number of disadvantages. One disadvantage is that they are not reusable. These metal retainer strips are equipped with tabs which break in use such that the retainer strips cannot be reloaded. Furthermore, if the tabs completely break off, there exists a danger that the tabs will fall into working parts of the firearm and cause jamming, excessive wear, and other problems. Another disadvantage of the prior-art retainer strips is that they freeze in cold, damp weather. When they are frozen, it is difficult or impossible to remove the cartridges. In an effort to melt frozen cartridge clips, soldiers in the field have been known to expose the retainer strips to open flame, which causes a great danger of exploding the attached cartridges.

Accordingly, it is an object of the present invention to provide an improved magazine loader substantially free of one or more of the disadvantages of the prior art.

Another object of the present invention is to provide an improved magazine loader which does not require the cartridges to be removed from the retainer strip prior to use and can accept the cartridges into the magazine loader with the retainer strip attached. Another object of the present invention is to provide an improved magazine loader that is simple and easy to manufacture and that can be made from thermoplastic in a single-step injection molding operation. Still another object of the present invention is to provide an improved magazine loader constructed of a single piece of thermoplastic.

Still another object of the present invention is to provide an improved cartridge clip which will constitute a replacement for the prior-art metal retainer strips; wherein the improved cartridge clip does not suffer from the disadvantages of the prior retainer strips; is reusable; does not have breakable tabs; and is not subject to freezing in cold, wet weather.

Figure 2:
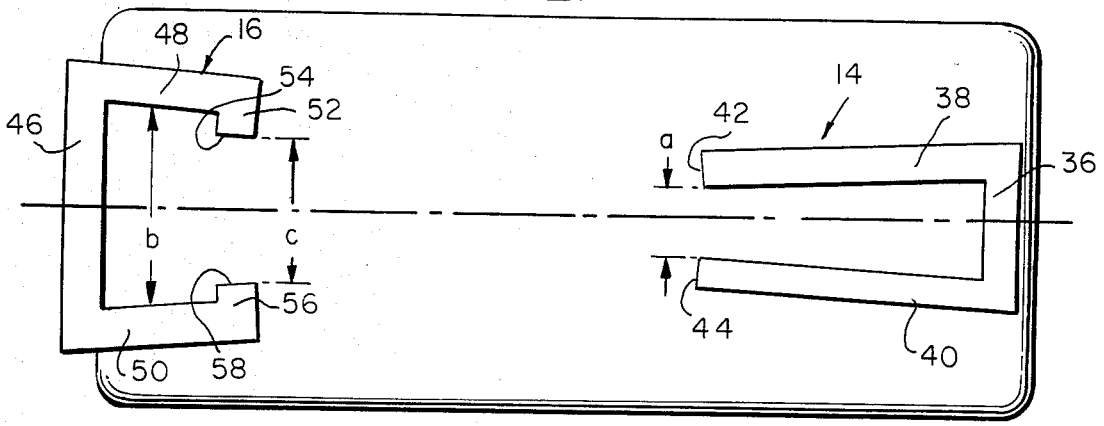
Figure 3:
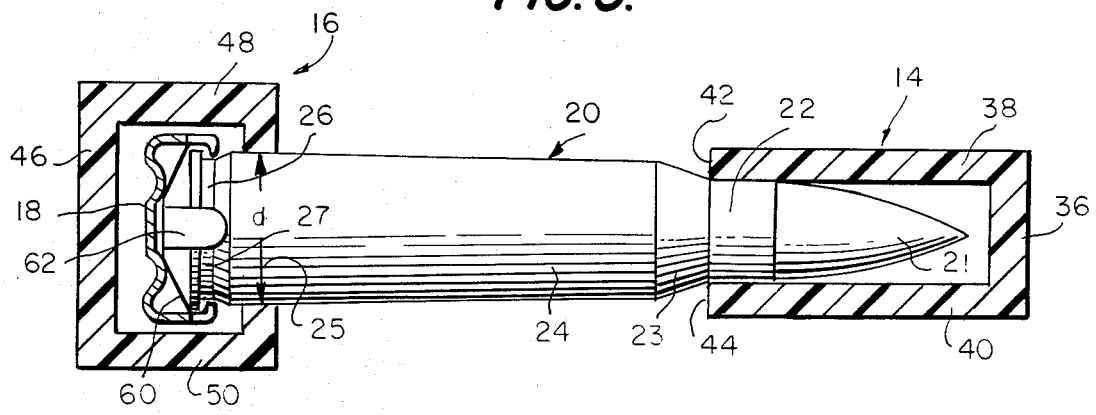
Figure 4:
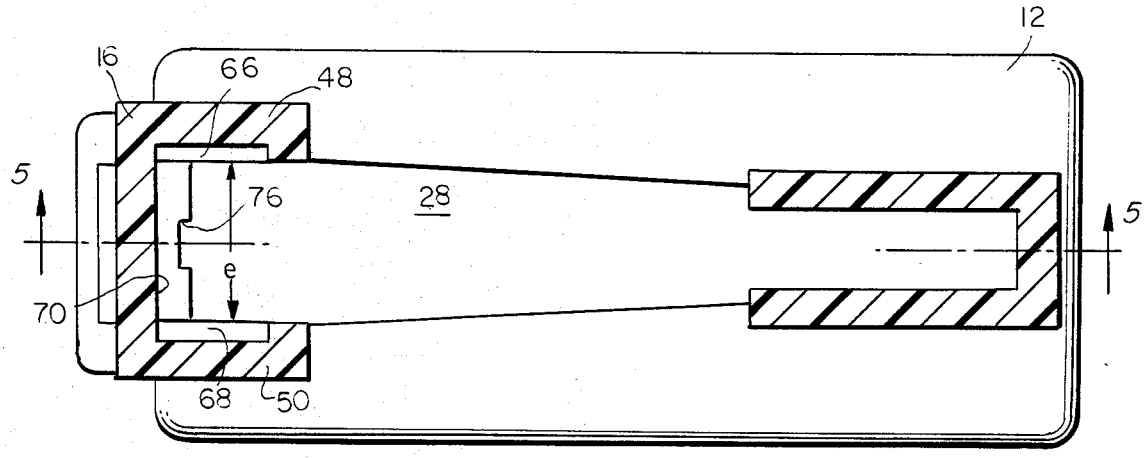
Figure 5:
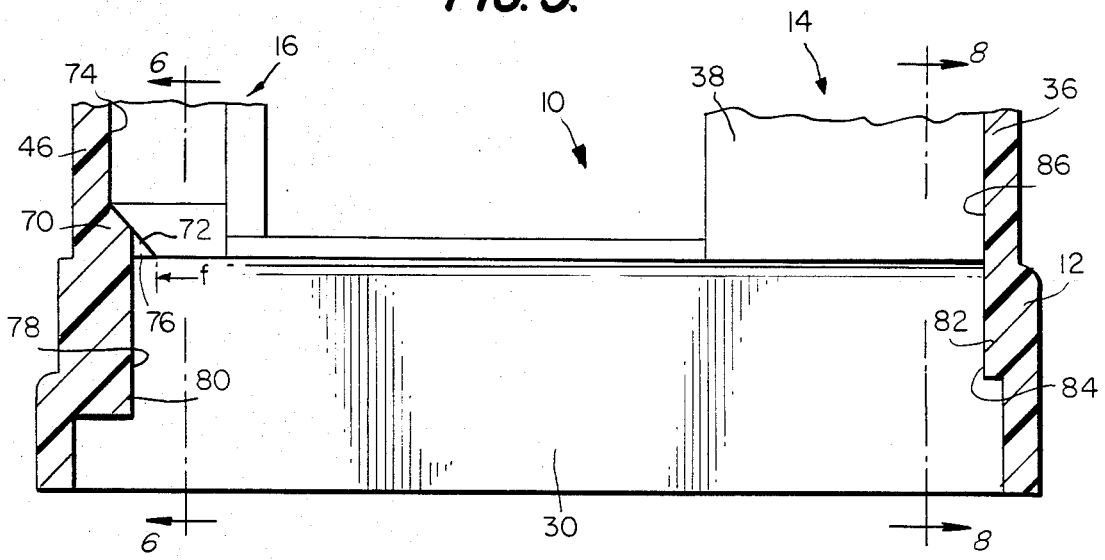
Figure 6:
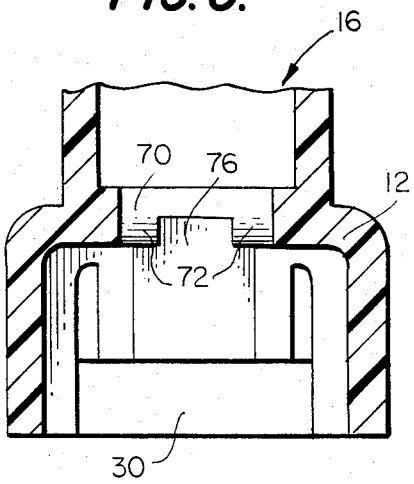
Figure 8:
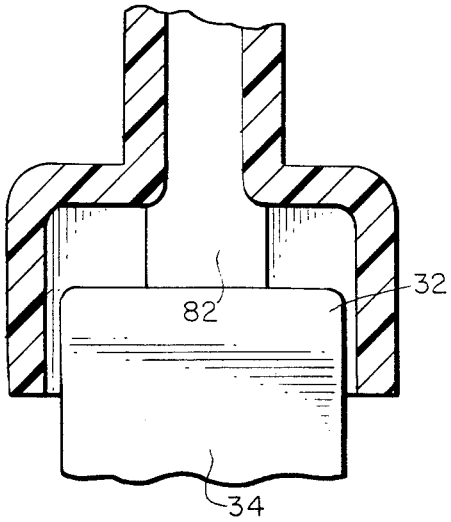
Figure 7:
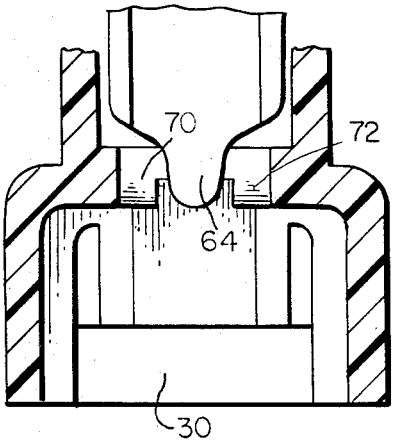
Figure 9:
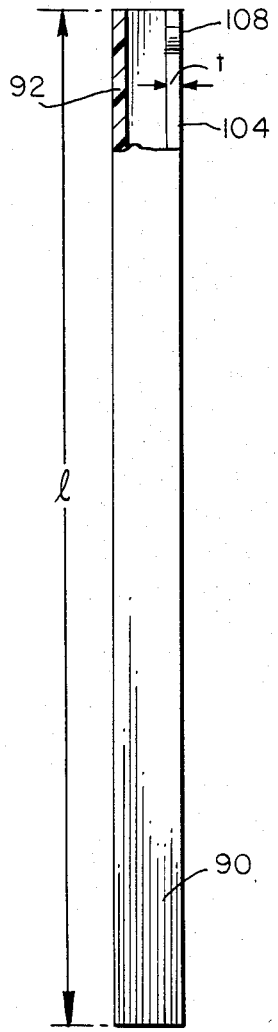
Figure 10:
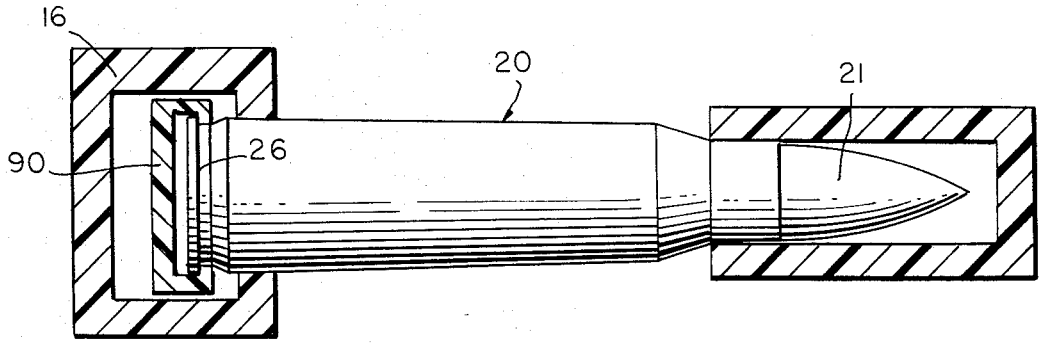

Other objects and advantages of the present invention will be apparent to those skilled in the art by reference to the following detailed description and drawings wherein:

FIG. 1 is a partially cutaway side view of a magazine loader of the present invention; and FIG. 2 is a top view of the magazine loader of the present invention but without any cartridges in the magazine loader; and FIG. 3 is a top view of the magazine loader of the present invention having a cartridge in the magazine loader; and FIG. 4 is a sectional view of the magazine loader of the present invention taken along line 4—4 of FIG. 1; and FIG. 5 is a sectional view of the magazine loader of the present invention taken along Line 5—5 of FIG. 4; and FIG. 6 is a sectional view taken along Line 6—6 of FIG. 5 but without any retainer strip in place; and FIG. 7 is a sectional view taken along Line 6—6 of FIG. 5 but with a retainer strip in place; and FIG. 8 is a sectional view taken along Line 8—8 of FIG. 5 but showing the top of a magazine which is not shown in FIG. 5; and FIG. 9 is a partially cutaway view of a cartridge clip of the present invention; and FIG. 10 is a top view similar to FIG. 3 but showing the magazine loader of the present invention when employing the catridge clip of FIG. 9.

Figure 11:
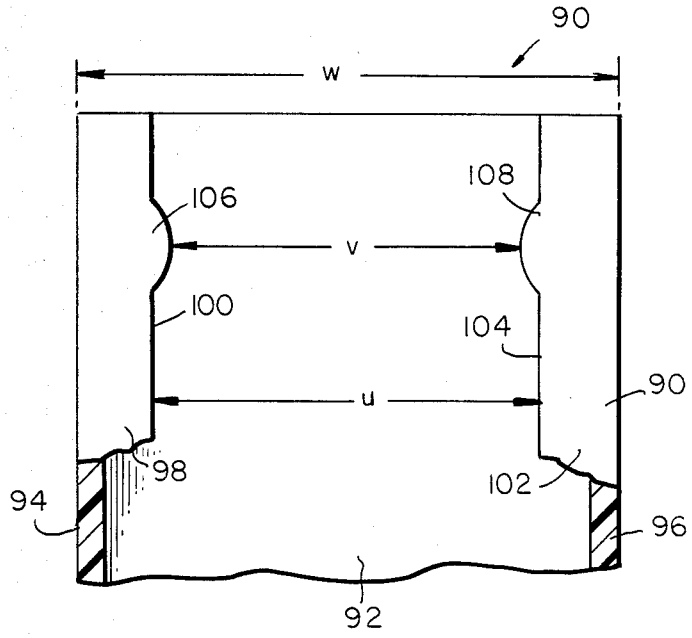

FIG. 11 is an enlarged, partially cut-away view of the cartridge clip of FIG. 9.

According to the present invention, there is provided a magazine loader for rapidly and easily loading cartridges into a firearm magazine. The magazine loader of the present invention comprises a skirt and a cartridge neck holder and a cartridge base holder attached to the skirt. The skirt has an open top through which cartridges pass. It also has an open bottom adapted to receive the magazine to be loaded. The cartridge neck holder is attached to the top of the skirt at its front end. The cartridge neck holder comprises an upwardly extending front support having two laterally extending neck arms attached to the front support at their forward ends. The laterally extending neck arms are adapted to slidably hold the neck of a cartridge. The cartridge base holder which is attached to the top of the skirt at its back end comprises an upwardly extending rear support and two laterally extending base arms. The base arms are attached to the rear support at their rearward ends. The laterally extending base arms are adapted to slidably hold the base of the cartridge. The base holder is adapted to receive cartridges held by a retainer strip, portions of which extend into the extractor recess of the cartridges.

Referring now to the drawings in general and in particular to FIG. 1, there is shown a magazine holder 10 of the present invention. The magazine holder 10 comprises a skirt 12, a cartridge neck holder 14 and a cartridge base holder 16. The cartridge base holder 16 is adapted to receive a retainer strip 18. As is well known, the cartridge 20 comprises a projectile 21 crimped within a neck 22 connected to a shoulder 23 which, in turn, is connected to the body 24 of the cartridge 20. The body 24 terminates in a base 25. The base 25 comprises an extractor recess 26 (see FIG. 3) and a rim 27 (see FIG. 3).

The skirt 12 has an open top 28 through which cartridges pass. The skirt 12 also has an open bottom 30. The open bottom 30 is adapted to slidably receive the cartridge receiving end 32 of a magazine 34 to be loaded (see FIG. 8).

Referring now to FIGS. 2 and 3, there is shown the cartridge neck holder 14 and the cartridge base holder 16 of the magazine loader 10 of the present invention. The cartridge neck holder 14 comprises an upwardly extending front support 36, a first laterally extending arm 38 and a second laterally extending arm 40. The two laterally extending arms 38,40 are attached to the front support 36 at their forward ends. The arm 38 terminates in a rearward extremity 42 whereas the arm 40 terminates in a rearward extremity 44. The distance "a" between the neck arms 38,40 at their rearward extremities 42,44 is less than the diameter of the neck 22 of the cartridge 20. As shown in FIG. 3, a cartridge 20 placed between the laterally extending neck arms 38,40 causes the laterally extending neck arms 38,40 to deflect outward against their natural spring force such that the laterally extending neck arms 38,40 slidably hold the neck 22 of the cartridge 20.

The cartridge base holder 16 comprises an upwardly extending rear support 46, a first laterally extending base arm 48 and a second laterally extending base arm 50. The base arms 48,50 are attached at their rearward ends to the rear support 46. The distance "b" between the laterally extending base arms 48,50 is greater than the width of the retainer strip 18. The laterally extending base arm 48 terminates on its forward end with a transversely extending segment 52 having a forward wall 54. Similarly, the laterally extending base arm 50 terminates in a laterally extending segment 56 which has a forward wall 58 which is opposite forward wall 54. The forward walls 54,58 are displaced one from the other a distance "c" which is substantially equal to the diameter "d" of the base 25 of the cartridge 20, wherein the distance between the forward wall of the rear support 46 and the rearward wall of the laterally extending segments 48,50 is slightly greater than the distance between that portion of the retainer strip 18 furthest removed from the cartridges 20 and a line connecting the forwardmost extremities of the retainer strip such that the retainer strip 18 can be held completely enclosed within the cartridge base holder 16.

The retainer strip 18 has within it a metallic spring member 60 which terminates in a bendable tab 62. The opposite end of the strip 18 has a similar bendable tab 64.

Referring now to FIG. 4, there are shown two juxtaposed shoulders 66,68 extending from the side walls 48,50 of the base holder 16 a distance "e" greater than the transverse dimension of the retainer strip 18 but less than the diameter "d" of the cartridge 20. By virtue of this structure, downward movement of the retainer strip 18 is stopped when pressure is applied to the cartridges, such as the cartridge 20, which are held within the retainer strip 18.

Referring now to FIG. 5, there is shown a ramp 70, the surface 72 of which is tilted at an angle to the surface of the rear support 46 of the base holder 16, but is contiguous thereto. The ramp 70 is provided with a recess 76 adapted to receive the bendable tab 64 (see FIG. 7). The recess 76 has a depth "f" sufficiently great to receive the entire bendable tab 64 while maintaining contact between the surface 72 of the ramp 70 and the rim 27 of the cartridge 20. The ramp 70 extends beyond the plane of the surface 78 of the rear land 80.

The skirt 12 is also provided with a forward land 82, the planar surface 84 of which is coincidental with the planar surface 86 of the inside of the front support 36.

The magazine loader of the present invention can be employed with the standard United States Government retainer strip 18. A standard retainer strip 18 containing ten cartridges held within the retainer strip by portions thereof which extend into the extractor recess 26 and held by two bendable tabs 62,64 can be easily and quickly placed in the cartridge base holder 16 with the lower end of the retainer strip 18 resting on the shoulders 66,68. The magazine loader 10 is placed on top of the magazine 34 (see FIG. 8) and application of finger pressure on the uppermost cartridge held within the retainer strip 18 causes the lowermost bendable tab 64 to bend downward into the recess 76 in the ramp 70 (see FIG. 7).

The retainer strip 18 holds the cartridges in the same relative horizontal position and the cartridge-neck holder 14 holds the neck 22 of the cartridges preventing lateral movement. The cartridges are caused to slide down the cartridge-neck holder 14 toward the skirt 12 and are caused to slide down the cartridge-base holder 16 toward the skirt 12 through the open top 28 of the skirt 12 and into the magazine 34 surrounded by the skirt 12. Contact is maintained between the base 25 of each cartridge 20 and the ramp 70 thus guiding each cartridge smoothly into the magazine 34.

The magazine loader 10 of the present invention can also be employed with a novel cartridge clip 90, as shown in FIGS. 9, 10 and 11. The cartridge clip 90 has a C-shaped cross section, the extremities of which grip the cartridge 20. The cartridge clip 90 is molded from a single piece of thermoplastic. The width "w" of the cartridge clip 90 is less than the distance "b" between the base arm 48 and the base arm 50 (see FIG. 2) such that the cartridge clip 90 fits into the cartridge base holder 16. It will be understood that the magazine loader 10 of the present invention can be employed without the cartridge clip 90, without the retainer strip 18 and without any other retainer strip simply by inserting the cartridges 20 with the neck 22 in the neck holder 14 and the base 25 in the base holder 16.

Further referring to FIGS. 9, 10 and 11, it can be seen that the cartridge clip 90 has a base 92. The base 92 has a length "l" that is slightly longer than the total number of cartridges to be held in the base 92. In a commonly occurring embodiment, the cartridge clip 90 holds ten cartridges. The base 92 has a width "w" that is only slightly wider than the diameter of a single cartridge 20 measured at the base of the cartridge 20. A left flexible arm 94 is attached to the base 92 and extends from the base 92 in a direction toward the projectile 21 of the cartridge 20. The base 92 is also equipped with a right flexible arm 96 which has similar structure. The right flexible arm 96 is substantially parallel to the left flexible arm 94. The left flexible arm 94 is attached to a left transversely extending segment 98 which terminates in a long straight face 100 having a width "t" which is less than the width of the extractor recess 26. The face 100 is adapted to slidingly engage the extractor recess 26 of the cartridge 20 as shown in FIG. 10. Similarly, the right transversely extending segment 96 has a right flexible arm 102 having a long straight face 104. The face 100 is parallel to the face 104 and is spaced there-from a distance "u" which is approximately equal to the diameter of the cartridge 20 measured in the extractor recess 26. Each of the two extremities of the face 100 and each of the two extremities of the face 104, i.e. a total of four extremities, terminate in bosses such as the boss 106 contiguous to the face 100 and the boss 108 contiguous to the face 104. The boss 106 is juxtaposed from the boss 108. The boss 106 is separated from the boss 108 by a distance "v" which is slightly less than the diameter of the cartridge measured within the extractor recess 26. By virtue of this relationship, the bosses 106,108 prevent accidental removal of the cartridge 20 from the cartridge clip 90.

I claim:

1. A magazine loader for rapidly and easily loading cartridges held by a standard retainer strip into a firearm magazine, each of said cartridges having a neck, a base and an extractor recess, said magazine loader comprising:

A. a skirt having an open top through which cartridges pass, an open bottom adapted to receive the magazine to be loaded, a front end, a base end opposite said front end, and two juxtaposed side walls, each of said side walls extending between the front end and the back end of the skirt; wherein the length of the open top is less than the length of the open bottom and the width of the open top is less than the width of the open bottom;

B. a cartridge-neck holder attached to the top of the skirt at its front end, said cartridge-neck holder comprising:

1. an upwardly extending front support; and
2. two laterally extending neck-arms attached to the front support at their forward ends, wherein the laterally extending neck-arms are adapted to slidably hold the neck of a cartridge; and C. a cartridge-base holder attached to the top of the skirt at its back end, said cartridge-base holder comprising:

1. an upwardly extending rear support; and
2. two laterally extending base arms attached to the rear support at their rearward ends, wherein the laterally extending base arms are adapted to slidably hold the base of a cartridge; and wherein the distance between the laterally extending base arms is greater than the width of the retainer strip which grips each cartridge by the extractor recess.

2. The magazine loader of claim 1 constructed from a single piece of thermoplastic.

3. The magazine loader of claim 1 constructed from a single piece of polypropylene.

4. The magazine loader of claim 1 having a pair of shoulders adapted to hold the retainer strip and prevent downward movement of the retainer strip when downward pressure is applied on cartridges held within the retainer strip.

5. The magazine loader of claim 1 further comprising a ramp in the skirt adjacent the base holder wherein said ramp constitutes means for causing cartridges to move forward upon leaving the base holder and upon entering the magazine.

6. A magazine loader for rapidly and easily loading cartridges into a firearm magazine, said magazine loader comprising:

A. a skirt having an open top through which cartridges pass and an open bottom adapted to slidably receive the cartridge-receiving end of a magazine to be loaded, wherein the front end of the inside of the skirt is provided with a land having a planar surface; and wherein said skirt is provided with a rear land having a planar surface; and B. a cartridge-neck holder attached to the top of the skirt at its front end, said cartridge-neck holder comprising:

1. an upwardly extending front support; and
2. two laterally extending arms attached to the front support at their forward ends; and wherein the distance between the neck arms at their rearward extremity is less than the diameter of the neck of a cartridge, such that a cartridge placed between the laterally extending neck arms causes the laterally extending neck arms to deflect outward against their natural spring force such that the laterally extending neck arms slidably hold the neck of the cartridge; and wherein the planar surface of the inside of the front support is coincidental with the planar surface of the forward land of the skirt; and C. a cartridge-base holder attached to the top of the skirt at its back end, said cartridge-base holder comprising:

1. an upwardly extending rear support; and
2. two laterally extending base arms attached to a rear support at their rearward ends; and wherein the distance between the laterally extending base arms is greater than the width of the metallic retaining strip adapted to grip cartridges by the extractor recess; and wherein each laterally extending base arm terminates on its forward end with a transversely extending segment, the forward walls of each of which are displaced one from the other a distance substantially equal to the diameter of the base of the cartridge; and wherein the base holder is adapted to receive cartridges held by a retainer strip, portions of which extend into the extractor recess of the cartridges; and wherein the distance between the forward wall of the rear support and the rearward wall of the laterally extending segments is slightly greater than the distance between that portion of the retainer strip furthest removed from the cartridges and a line connecting the forwardmost extremities of the retainer strip such that the retainer strip can be held completely enclosed within the cartridge base holder; and wherein the cartridge base holder is further provided with two juxtaposed shoulders extending from the side walls of the base holder a distance greater than the transverse dimension of the retainer strip but less than the diameter of a cartridge whereby downward movement of the retainer strip is stopped when pressure is applied to cartridges held within the retainer strip; and wherein the magazine loader is provided with a ramp, the surface of which is tilted at an angle to the surface of the rear support of the base holder but contiguous thereto; and wherein said ramp is provided with a recess adapted to receive a bendable tab attached to the retainer strip, wherein said recess has a depth sufficiently great to receive the entire bendable tab while still maintaining contact between the surface of the ramp and the rim of the cartridge; and wherein each ramp extends beyond the plane of the surface of the rear land of the skirt; and whereby a standard retainer strip containing ten cartridges held within the retainer strip by portions thereof which extend into the extractor recess and held by two bendable tabs can be easily and quickly placed in the cartridge base holder with the lower end of the retainer strip resting on the shoulders; and whereby application of finger pressure on the uppermost cartridge held within the retainer strip causes the lowermost bendable tab to bend downward into the recess in the ramp; and whereby the retainer strip holds the cartridges in the same relative horizontal position and whereby the cartridge-neck holder holds the neck of the cartridges preventing lateral movement; and whereby the cartridges are caused to slide down the cartridge-neck holder toward the skirt and are caused to slide down the cartridge-base holder toward the skirt through the open top of the skirt and into the magazine surrounded by the skirt; and whereby contact is maintained between the base of each cartridge and the ramp thus guiding each cartridge smoothly into the magazine.

7. A magazine loader for rapidly and easily loading cartridges into a firearm magazine, each of said cartridges having a neck and an extractor recess, said magazine loader comprising:

A. a skirt comprising:

1. an open top through which cartridges pass; and
2. an open bottom adapted to slidably receive the cartridge-receiving end of a magazine to be loaded; and
3. a front end, the inside of said front end being provided with a forward land having a planar surface; and
4. a back end provided with a rear land having a planar surface; and B. a cartridge-neck holder attached to the top of the skirt at its front end, said cartridge-neck holder comprising:

1. an upwardly extending front support, the inside of said front support being a planar surface coincidental with the planar surface of the forward land of the skirt; and
2. two laterally extending neck arms attached to the front support at their forward ends, the distance between the neck arms at their rearward extremity being less than the diameter of the neck of a cartridge such that neck arms slidably hold the neck of the cartridge; and C. a cartridge-base holder attached to the top of the skirt at its back end, said cartridge-base holder comprising:

1. an upwardly extending rear support; and
2. two laterally extending base arms attached to the rear support at their rearward ends, the distance between said laterally extending base arms being greater than the width of a retainer strip adapted to grip cartridges by the extractor recess, each of said base arms having a transversely extending segment at its forward end, each of said transversely extending segments terminating in a forward wall, said forward walls being displaced one from the other a distance substantially equal to the diameter of the base of the cartridge; and
3. two juxtaposed shoulders extending from the base arms, the distance between said shoulders being greater that the diameter of a cartridge and less than the width of the retainer strip, whereby downward movement of the retainer strip is stopped when pressure is applied to cartridges held within the retainer strip; and
4. a ramp, said ramp having a surfacwe tilted at an angle to the inner surface of the rear support of the base holder but contiguous thereto, said ramp being provided with a recess adapted to receive a bendable tab of the retainer strip and said ramp extending beyond the plane of the surface of the rear land of the skirt; and wherein, the base holder is adapted to receive cartridges held by a retainer strip such that the retainer strip is completely enclosed within the base holder; and wherein a standard retainer strip containing ten cartridges held within the retainer strip by portions thereof which extend into the extractor recess and held by two bendable tabs can be easily and quickly placed in the cartridge base holder with the lower end of the retainer strip resting on the shoulders; and wherein application of finger pressure on the uppermost cartridge held within the retainer strip causes the lowermost bendable tab to bend downward into the recess in the ramp; and wherein the cartridges are caused to slide down the cartridge-neck holder toward the skirt and are caused to slide down the cartridge-base holder toward the skirt through the open top of the skirt and into the magazine surrounded by the skirt; and wherein contact is maintained between the base of each cartridge and the ramp thus guiding each cartridge smoothly into the magazine.

* * * * *

UNITED STATES PATENT OFFICE

CERTIFICATE OF CORRECTION

Patent No. 4,538,371 Dated September 3, 1985

Inventor(s) William J. Howard

It is certified that error appears in the above-identified patent and that said Letters Patent are hereby corrected as shown below:

Column 5, Line 23, delete [base] and insert --back--.

Column 7, Line 6, delete [each] and insert --said--.

Column 8, Line 26, delete [surfacwe] and insert --surface--.

Signed and Sealed this

*Fifth* Day of *November 1985*

[SEAL]

*Attest:*

*Attesting Officer*

DONALD J. QUIGG

*Commissioner of Patents and Trademarks*